United States Patent [19]

Waterman et al.

[11] Patent Number: 4,777,888

[45] Date of Patent: Oct. 18, 1988

[54] CANTILEVER WALL-MOUNT SHELVING

[75] Inventors: Dewey J. Waterman, Newton Township, Calhoun County; David V. Kavnor, Battle Creek, both of Mich.

[73] Assignee: United Steel & Wire Company, Battle Creek, Mich.

[21] Appl. No.: 143,254

[22] Filed: Jan. 4, 1988

Related U.S. Application Data

[63] Continuation of Ser. No. 61,065, Jun. 10, 1987.

[51] Int. Cl.[4] ..... A47F 5/12

[52] U.S. Cl. ..... 108/108; 248/249; 248/250

[58] Field of Search ..... 108/108, 106, 107, 110; 248/248, 249, 250; 211/90

[56] References Cited

U.S. PATENT DOCUMENTS

| | | | |
|---|---|---|---|
| 1,905,908 | 4/1933 | Karnes | 108/108 |
| 2,271,784 | 2/1942 | Tritt | 248/250 |
| 3,194,528 | 7/1965 | Chesley | 248/250 |
| 3,355,134 | 11/1967 | Chesley | 248/250 |
| 3,701,325 | 10/1972 | Fenwick | 108/108 X |
| 4,319,792 | 3/1982 | Britt et al. | 211/153 |
| 4,624,376 | 11/1986 | Bertram | 248/250 X |
| 4,669,692 | 6/1987 | Mastrodicasa | 248/250 |

FOREIGN PATENT DOCUMENTS

| | | | |
|---|---|---|---|
| 782416 | 4/1968 | Canada | 108/108 |
| 318690 | 12/1969 | Sweden | 248/250 |

OTHER PUBLICATIONS

METRO Super Erecta Shelf Wall Mounts, Copyright 1979, Metropolitan Wire Corporation, Wilkes-Barre, PA 18705, No. 10.40.

METRO Regular Erecta Shelf Shelving Accessories, Copyright 1979, Metropolitan Wire Corp., Wilkes-Barre, PA 18705.

UNITED Direct Wall Mount Shelves.

AMCO II Shelving.

*Primary Examiner*—Peter A. Aschenbrenner

*Attorney, Agent, or Firm*—Flynn, Thiel, Boutell & Tanis

[57] ABSTRACT

A shelf arrangement adapted to be mounted on an upright wall in cantilevered relationship thereto, which arrangement includes a wire shelf releasably supported by a pair of underlying brackets. The brackets attach to and project in cantilevered relationship from the wall by wall clamps which fixedly attach to the wall. Each bracket has upper and lower legs which, at their rearward ends, terminate in a pair of sidewardly-spaced leg portions which terminate in a pair of sidewardly-spaced hooks which engage a respective wall clamp. The wall clamp has sidewardly-spaced hook receiving parts, and also has a center part which accommodates fasteners for direct attachment to a wall, particularly to an underlying wall stud. A pair of shelf supports project upwardly from the bracket and have, at their upper ends, rearwardly-opening hook parts which engage front and rear support rods which are fixed to the shelf and extend longitudinally thereof.

9 Claims, 2 Drawing Sheets

CANTILEVER WALL-MOUNT SHELVING

This application is a continuation of U.S. Ser. No. 061,065, filed June 10, 1987.

FIELD OF THE INVENTION

This invention relates to a cantilevered wall-mounted shelf arrangement.

BACKGROUND OF THE INVENTION

Numerous cantilevered shelf arrangements are attached to upright walls to permit storage or display of goods. Such shelf arrangements are increasingly utilized in commercial establishments such as retail stores, restaurants and other businesses. Such shelving arrangements often involve brackets which secure to the wall and project outwardly therefrom so as to underlie and attach to the shelf. Such brackets and shelves are conventionally fabricated from metal wire or rod suitably formed and welded to provide the desired strength and configuration. The brackets typically attach to the shelf solely at the ends thereof, and hence the securement of the brackets to the wall is positionally determined by the shelf length and the desired position of the shelf laterally along the wall. In some instances, one or more intermediate brackets are also provided, such normally being secured to and under the shelf at predetermined intermediate locations. With such arrangements, the secure attachment to the wall at a desired location therealong has presented a formidable problem since, once the optimum position of the shelf is determined, this hence predetermines the bracket location. In many instances the wall does not have the necessary structure, such as the necessary underlying vertical studs, to permit securement of the brackets to the wall with sufficient strength to permit the shelf to carry the desired load. In such instances, it is often necessary to shift the shelf laterally along the wall into a less than optimum position, and in effect align the shelf and specifically the brackets at the ends thereof with the underlying studs in order to permit secure attachment of the shelf to the wall. This hence severely restricts the positioning of the shelf along the wall. This also severely restricts the length of the shelf itself since, in some walls, the studs are on 16 inch centers and in others on 24 inch centers. The shelves thus must normallY have lengths corresponding to whole number multiples of these center line distances.

Further, even when the known shelving units have been properly aligned with the studs to permit proper securement to the wall, it has been observed that many of the shelf brackets utilize wall clamps which have a central hook-receiving opening for receiving the inner end of the bracket, and this wall clamp in turn has fasteners on opposite sides of the hook-receiving opening which are intended to screw into the stud. However, since the stud itself is typically of narrow width, such as one and one-half inches, it has been observed that the wall clamp must be extremely accurately aligned over the studs in order for the sidewardly-spaced fasteners to penetrate the stud. Such alignment is normally impossible to achieve, particularly with respect to a pre-existing wall due not only to the nonvisibility of the studs, but due also to the inherent irregularities which exist with respect to the spacing between the studs.

Accordingly, it is an object of this invention to provide an improved shelf arrangement which is highly effective in overcoming or eliminating the aforementioned disadvantages.

More specifically, this invention relates to a shelf arrangement which permits the shelf to be selectively laterally positioned along the wall substantially at any desired location, with the shelf being attached to the wall by a pair of cantilevered brackets which attach to the wall and project outwardly beneath the shelf. The brackets releasably attach to the shelf at any desired location longitudinally therealong, and hence not necessarily at the ends thereof. The brackets can hence be positioned to properly align with the wall structure, such as the underlying studs in the wall, and hence the brackets themselves can be attached to the shelf so as to permit the latter to be nonsymetrically positioned relative to the brackets, and hence disposed in the desired lateral position along the wall.

In the shelf arrangement of the present invention, another advantage relates to the manner in which the brackets are cantilevered from and attach to the wall clamps which fixedly attach to the wall. The wall clamps have center parts which directly overlie the wall, and threaded fasteners extend through the center parts for securement to the underlying studs. The center part is disposed between a pair of hook-receiving parts. The rear of the bracket terminates in sidewardly spaced portions which themselves terminate in downwardly-oriented hooks which engage the sidewardly-spaced hook-receiving parts of the wall clamp. This arrangement facilitates the alignment with and securement of the wall clamps to the underlying studs.

In the improved arrangement of this invention, as aforesaid, the brackets are preferably constructed from wire rod and are preferably provided with a pair of shelf supports projecting upwardly therefrom in spaced relationship therealong for respectively engaging front and rear support rods which extend longitudinally along the shelf. Each of the upwardly-adjusting shelf supports cantilevers upwardly and at its upper end terminates in a rearwardly-oriented U-shaped hook which engages one of the support rods. This arrangement provides for secure supporting of the shelf on the bracket, and at the same time positively locks the shelf toward and preferably against the wall to prevent disengagement of the shelf from the brackets.

Other objects and purposes of the invention will be apparent to persons familiar with structures of this general type upon reading the following specification and inspecting the accompanying drawings.

Figure 2:
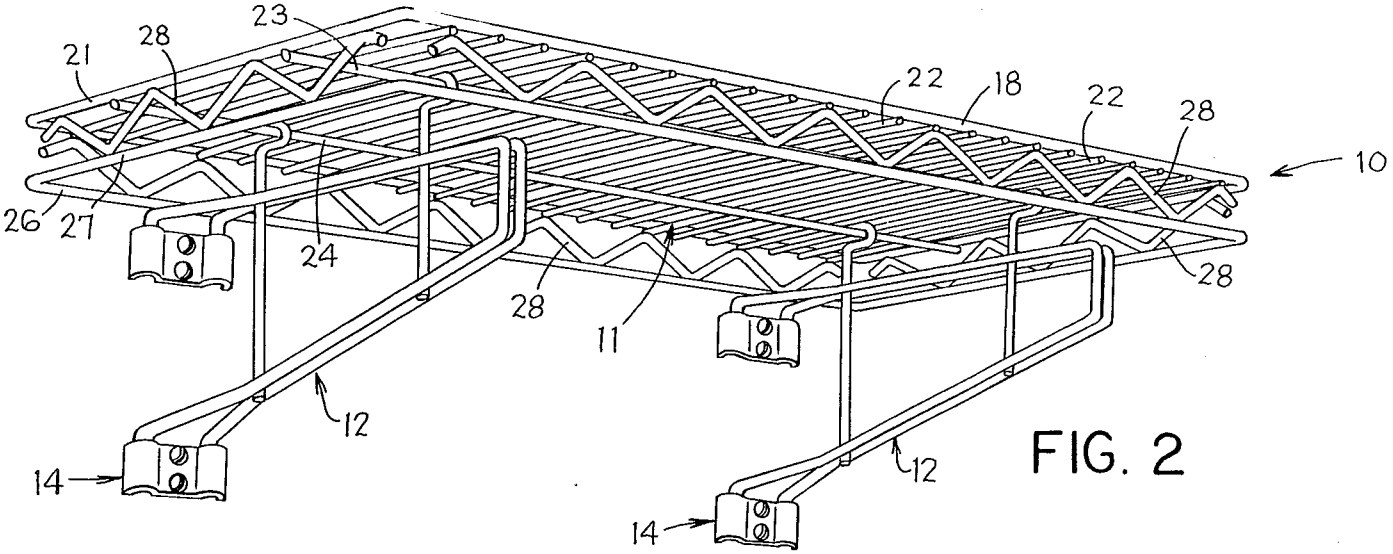
FIG. 2 is a front perspective view similar to FIG. 1 but taken from below.

Certain terminology will be used in the following description for convenience in reference only, and will not be limiting. For example, the words "upwardly", "downwardly", "rightwardly" and "leftwardly" will refer to directions in the drawings to which reference is made. The word "upper" will also refer to the upper load bearing side of the shelf, this being the uppermost side in FIG. 3. The word "front" will be used to refer to the edge of the shelf arrangement furthest removed from the wall, namely the rightwardmost edge in FIG. 3, and the word "rear" will refer to the opposite edge, namely the edge adjacent the wall. The words "inwardly" and "outwardly" will refer to directions toward and away from respectively the geometric center of the arrangement and designated parts thereof. Said terminology will include the words specifically mentioned, derivatives thereof, and words of similar import.

DETAILED DESCRIPTION

Figure 1:
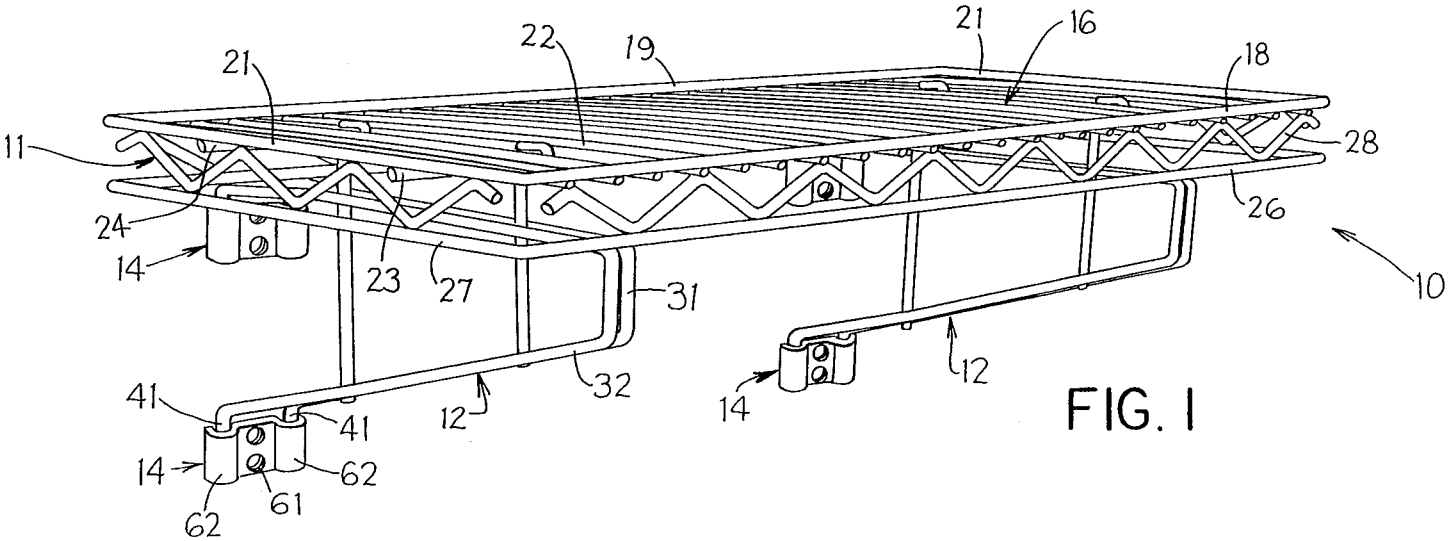
FIG. 1 is a front perspective view, taken from above, and illustrating the shelf arrangement according to the invention.

FIGS. 1 and 2 illustrate therein a shelf arrangement 10 adapted to be mounted in cantilevered relationship relative to an upright wall. More specifically, this shelf arrangement includes a horizontally-enlarged shelf 11 supported on a pair of underlying longitudinally-spaced brackets 12 which project outwardly from the wall 13 (FIGS. 3 and 4) in cantilevered relationship thereto. The wall 13 mounts thereon wall clamps 14 which releasably engage the rearward ends of the brackets 12. These wall clamps 14 are intended to be disposed directly over and hence fixedly secured to the interior studs 15 which are disposed within the wall and extend vertically thereof.

The construction of the shelf 11 is generally conventional in that it includes a substantially planar top mat 16 which in effect defines the upwardly facing top surface adapted to support thereon goods or articles. This mat 16 is formed from a plurality of parallel metal wires or rods 22 which are disposed in sidewardly spaced relationship and extend transversely across the width of the shelf. The mat wires 22 are fixedly secured to and supported on upper generally-parallel longitudinally extending wires or rods 18 and 19 which are respectively disposed adjacent the front and rear edges of the shelf. These longitudinal rods 18 and 19 are normally fixedly joined adjacent their ends by transversely extending end wires or rods 21.

The shelf also includes lower longitudinally extending edge wires or rods 26 which are parallel with and spaced directly downwardly from the upper edge rods 18 and 19. Similar lower end rods 27 are spaced downwardly from the upper end rods 21 and are rigidly joined between the ends of the bottom edge rods 26. The respectively adjacent upper and lower rods are rigidly secured together by means of a welded truss wire 28 extending vertically therebetween, which truss wire extends longitudinally along both the front and rear edges of the shelf, and also preferably along the side or end edges thereof.

The upper and lower support rods, as described above, conventionally are formed from a single elongated rod which is suitably bent to form a substantially rectangular configuration corresponding to the shelf. The structure of the shelf, as described above, is conventional.

The mat 16 associated with the shelf, in the present invention, is additionally provided with front and rear support rods 23 and 24, respectively, disposed so as to extend longitudinally of the shelf throughout substantially the full length thereof. These support rods 23 and 24 extend generally parallel with one another, and parallel with the edge rods 18 and 19. The support rods 23 and 24 are disposed directly under and are fixedly secured to the transverse wires 22 at the crossing points, as by welding. The front support rod 23 is spaced rearwardly a selected transverse distance from the front edge rod 18, and similarly the rear support rod 24 is faced transversely forwardly a selected distance from the rear edge rod 19, these distances being equal in the illustrated embodiment so that the rods 23 and 24 are hence disposed equally spaced on opposite sides of the longitudinally extending center line of the shelf. The transverse spacing between the rods 23 and 24, in the illustrated embodiment, is preferably about twice the spacing of the front and rear support rods from their respective front and rear edge rods.

The shelf 11, as described above, is thus formed entirely of metal wire or rod which is suitably formed and then welded together so that the shelf hence comprises a one-piece unitary structure.

Figures 3, 4, 5:
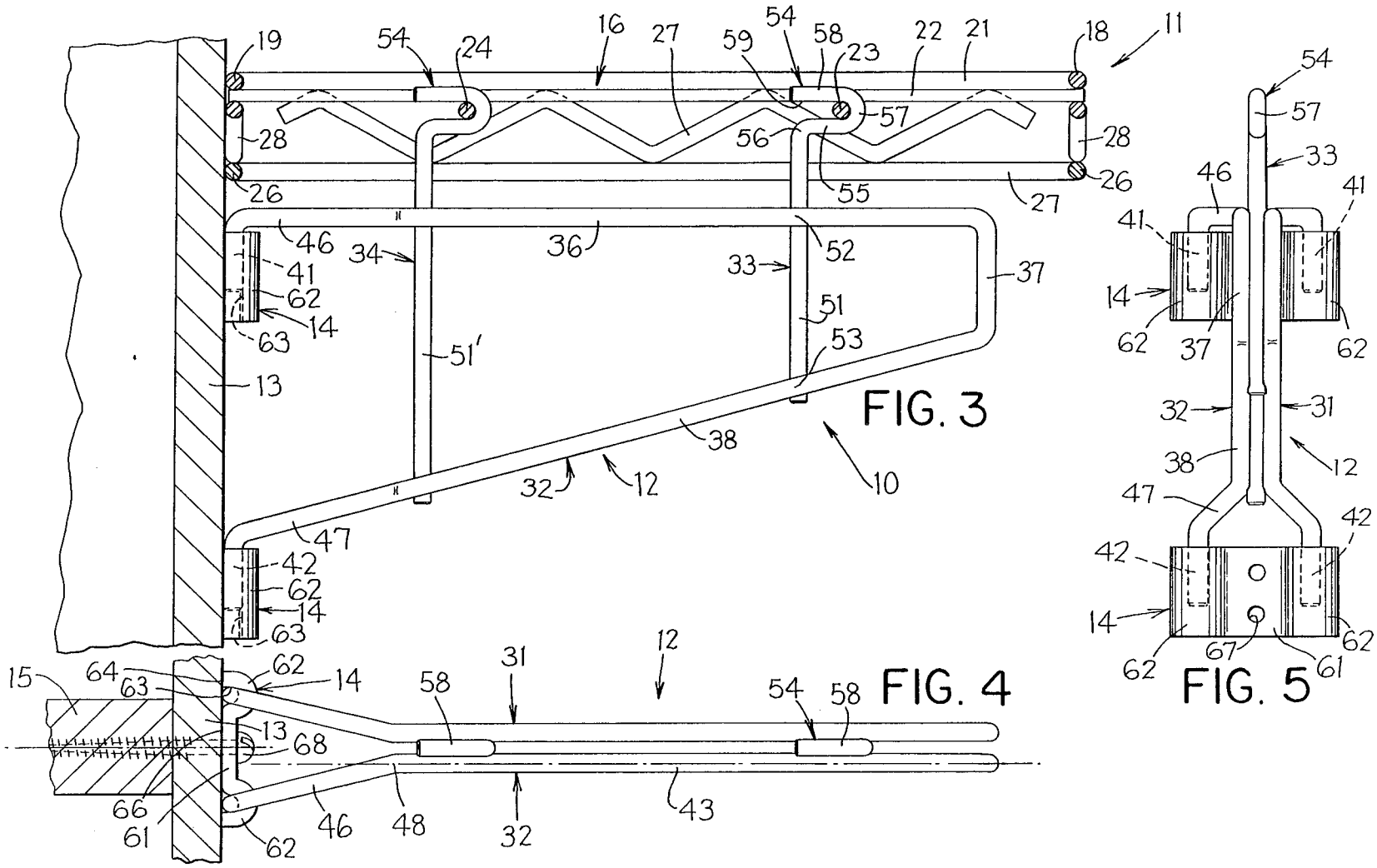
FIG. 3 is an end elevational view showing the shelf arrangement, partially in vertical cross section, attached to an upright wall.
FIGS. 4 and 5 are respectively top and front views of the bracket arrangement of FIG. 3, the shelf being eliminated for clarity of illustration.

Considering now the brackets 12, and referring to FIGS. 3–5, each bracket is preferably formed by right and left frame elements 31 and 32, respectively, which elements are identical except for being mirror images of one another when viewed about a central vertical plane extending transversely (i.e., perpendicularly) relative to the upright wall. These right and left frame elements 31 and 32 are fixedly secured to opposite sides of a pair of shelf supports 33 and 34, which shelf supports 33 and 34 are themselves substantially identical (except for length) and are spaced from one another in the transverse direction.

The left frame element 32 is, in the preferred embodiment, formed from a single elongated wire or rod and includes a substantially horizontally extending top leg 36 which at its forward end is bent through a substantially 90° corner so as to join to a downwardly projecting front leg 37. This front leg 37, at its lower end, is also suitably bent rearwardly so as to join to a rearwardly projecting bottom leg 38, the latter being disposed directly under the top leg 36 but is sloped downwardly at a slight angle, such as in the order of about 20° to 30°, as it projects rearwardly toward the wall. These legs 36–38 hence in effect define a rearwardly-opening U-shaped element which functions as an arm which is disposed so as to project outwardly from the wall beneath the shelf.

The left frame element 32 also includes a pair of vertically-spaced hook parts 41 and 42. The upper hook part 41 is fixed, here integrally, to the rearward end of the top leg 36 and projects vertically downwardly therefrom. Similarly, the lower hook part 42 is fixed, here integrally, to the rearward end of the bottom leg 38 and projects vertically downwardly therefrom. These hook parts 41 and 42 are vertically elongated and substantially vertically aligned one over the other.

As illustrated by FIG. 4, a majority of the arm as defined by the legs 36–38 is disposed within a vertical plane 43 which extends perpendicularly relative to the wall 13. However, the hook parts 41–42 are displaced sidewardly a small distance relative to this plane 43, which sideward displacement is accomplished by providing the upper and lower legs 36 and 38 with rear portions 46 and 47, respectively, which are sidewardly offset from the plane 43. This sideward offset, in the illustrated embodiment, is accomplished by providing a slight sideward bend 48 in the legs at a location spaced a small distance forwardly from the hooks 41, whereby the rear leg portions 46 and 47 hence flare or slope outwardly at a small angle relative to the plane 43 as they project rearwardly. These rear leg portions 46 and 47, in the illustrated embodiment, preferably flare sidewardly from the bend 48 at an angle of about 10° to 15° relative to the plane 43.

Alternately, the rear leg portions 46 and 47 could be disposed sidewardly in parallel relationship with the rest of the respective leg, this being accomplished by forming two intermediate bends joined between a short sidewardly extending leg portion, although such would require more and severe bending of the legs and hence the embodiment illustrated by FIGS. 3–5 is highly preferred.

As noted above, the right frame element 31 is a mirror image of the left frame element 32, and hence these frame elements are identical except that the rear leg portions 46–47 hence flare sidewardly in opposite directions relative to the respective central plane 43, and hence the rear leg portions of the right and left brackets thus define a V-shaped configuration as they project rearwardly. Each of the right and left frame elements define upper and lower hook parts 41 thereon, whereby this V-shaped flared arrangement at the rearward ends of the bracket hence results in the upper pair of hooks 41 being sidewardly spaced apart through a small predetermined distance, and the lower pair of hooks 42 is similarly sidewardly spaced.

Concerning now the front shelf support 33 as associated with the bracket, it includes a lower straight rod part 51 which is oriented vertically and is disposed directly between the right and left frame elements and is suitably fixedly secured, as by welding, to the upper and lower legs thereof at the points of intersection, such as at the points 52 and 53. The straight rod part 51 projects vertically upwardly a selected extent above the upper leg 36 and, at its upper end, is integrally formed with a U-shaped hook part 54 which is disposed generally within a vertical plane and opens rearwardly. This hook part 54 includes a bottom leg 55 which is integrally joined by a bend 56 to the upper end of the rod part 51 and projects forwardly therefrom. This lower leg 55 in turn is joined to a bight portion 57 which extends upwardly and is joined to a top leg 58 which projects rearwardly in generally parallel relationship to the bottom leg 55. This top leg 58 terminates in a free end which is disposed generally over the straight vertical rod part 51. The bottom and top legs 55 and 58 define therebetween a slot 59 which opens rearwardly. This slot is closed at its forward end by the bight 57. The slot has a front-to-back depth which preferably is several times greater than the diameter of the front support rod 23, and the slot 59 has a width as measured perpendicularly between the legs 55 and 58 which substantially equals or only slightly exceeds the diameter of the support rod 23. The bight 57 is preferably bent about a radius such that the inner surface of the bight closely conforms with the outer circumference of the support rod 23.

Except for the length of the rod part 51', the rear shelf support 34 is formed identically to the front shelf support 33, and the hook part 54 thereof is adapted to engage the rear support rod 24. The transverse or widthwise spacing between the front and rear shelf supports 33 and 34 is substantially identical to the transverse spacing between the support rods 23 and 24.

In addition, in the preferred embodiment, the rear shelf support 34 is positioned so that when the bracket 12 is attached to the wall and the shelf 11 is supported thereon, the rear support rod 24 will be seated in the closed end of the slot against the bight 57, and the rear edge of the shelf 11 will abut and preferably be urged against the front surface of the wall 13. This is accomplished by making the transverse dimension between the rear surface of the hooks 41 and the radius center of the bight 57 equal to or slightly less than the transverse dimension between the outer rear edge of the shelf and the longitudinal center of the support rod 24. In this manner, the rod 24 is hence seated in the blind end of the slot defined by the hook 54, which hook 54 can be slightly resiliently deflected due to the cantilevered relationship thereof above the top leg 36, thereby urging and holding the rear edge of the shelf firmly against the wall.

Alternately, or in conjunction therewith, a similar relationship can be achieved between the hook 54 of the front shelf support 33 and its associated support rod 23, whereby the shelf can hence be urged rearwardly and snugly held in engagement with the face of the wall 11.

The bracket 12 is secured to the wall 13 by a pair of identical wall clamps 14, one for the upper pair of hooks 41, and the other for the lower pair of hooks 42. Each bracket 14 is formed from a small and substantially rectangular plate and includes a substantially flat center part 61 which extends horizontally between vertically extending edge parts 62. The edge parts 62, in horizontal cross section, are of a generally U-shaped cross section and define a slot 63 which opens rearwardly (i.e., toward the wall). The edge parts 62 terminate free edges 64 which are disposed substantially coplanar with the rear surface 66 of the centerpart 61, which surface 66 is adapted to directly engage the front face of the wall 13.

The slots 63 extend vertically throughout the complete height of the wall clamp and are open at the upper and lower ends thereof. The wall clamp is thus symmetrical about the central horizontal and vertical axes thereof. The slot 63 has a width and depth, in cross section, which approximately equals or only slightly exceeds the diameter of the rod defining the hook parts 41 and 42 so that the hook parts can freely slide downwardly into the slots 63 and be snugly accommodated therein when the clamp 14 is secured to the wall.

To secure the clamp 14 to the wall, the center part 61 has a pair of openings 67 therethrough, each of which accommodates an elongate fastener 68 (such as a screw) which can be fed therethrough and thence through the wall so as to be tapped into the underlying stud 15.

OPERATION

With the shelf arrangement 10 of the present invention, the installer has substantial flexibility in positioning of the brackets 12 since they do not have to be directly at the shelf edges, and in fact they do not even have to be symmetrically positioned relative to the opposite end edges of the shelf. Hence, the installer can locate within the selected shelf length a pair of spaced wall studs 15. The installer then attaches the wall clamps 14 to the studs, two such clamps 14 being attached to each stud in vertically spaced relationship substantially as illustrated by FIGS. 1 and 2. The fact that the threaded fasteners 67 extend through the center part 61 of the wall clamp hence enables each wall clamp to be easily threaded into the wall stud 15 so as to permit secure attachment of the wall clamp thereto.

Thereafter, the pair of brackets 12 are attached to the shelf 11 in the desired spaced relationship, such as by slipping the hook parts 54 of the supports 33 and 34 over the respective support rods 23 and 24. The thus-assembled shelf 11 and brackets 12 are then moved against the wall so that the hooks 41 and 42 are disposed directly over the slots 63 formed in the wall clamps 14, whereupon the shelf-bracket assembly is slidably moved downwardly along the wall until the hooks 41 and 42 are fully inserted into the wall clamps.

The overall assembly, when mounted on the wall as described above, is hence disposed so that the rear edge of the shelf 11 is held closely adjacent and preferably in engagement with the face of the wall. In fact, the upper cantilevered portions of the supports 33 and 34 are preferably resiliently deflected slightly forwardly and hence resiliently urge the shelf 11 rearwardly so as to maintain snug engagement thereof with the wall 13.

The assembled shelf arrangement hence can be disposed so that the brackets 12 are located longitudinally along the shelf 11 at any desired location suitable for attachment to an underlying wall stud 15, this being permissible since the brackets 12 attach to the longitudinally extending support rods 23–44 of the shelf, and not the shelf ends. In fact, the hook parts 54 associated with the brackets 12 can engage the rods 23–24 longitudinally along the shelf between any adjacent pair of transverse wires 22. However, it is obviously recommended that the pair of brackets 12 be spaced as far apart as possible and as close to the opposite end edges of the shelf as possible in order to provide for optimum support of the shelf.

Further, for shelves of longer length, three or more identical brackets 12 can be utilized since the design of the bracket 12 enables the use of additional such brackets disposed at any desired intermediate location along the shelf so as to provide additional support, if necessary or desired.

The "flared feet" at the rearward ends of the brackets 12, and the manner in which they provide pairs of sidewardly spaced hooks 41 and 42, also increase the overall stability of the shelf arrangement since they not only increase the stability with respect to mounting of the bracket on the wall, but this stability also attributes to and increases the overall stability of the shelf and its securement to the wall. This stability is further enhanced by the manner in which the shelf is positively restrained vertically by the positive securement of the support rods 23–24 within the respective hooks 54, and is further increased by the manner in which the supports 33 and 34 urge and hold the rear edge of the shelf against the wall, thereby providing additional frictional holding which increases the stationary stability of the shelf arrangement.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A shelving arrangement adapted to be mounted on an upright wall so as to project outwardly therefrom in cantilevered relationship thereto, comprising:

a horizontally enlarged shelf having a substantially planar upper mat which defines an upwardly facing support surface, said mat extending between longitudinally-extending front and rear edges of said shelf;

said shelf including substantially parallel front and rear support rods which are fixed relative to said mat and extend longitudinally of said shelf, said support rods being spaced a predetermined distance apart;

a pair of bracket assemblies disposed below and in spaced relationship longitudinally along said shelf and individually connected between said shelf and said wall;

each said bracket assembly including a wall clamp means fixed to said wall, and a cantilevered bracket releasably connected to said clamp means and projecting outwardly therefrom for releasable engagement with said front and rear support rods;

said bracket including a horizontally-elongated arm having hook means for vertically slidably engaging said wall clamp means, said arm projecting outwardly from said wall in cantilevered relationship thereto and being disposed below said shelf;

said bracket also including front and rear shelf supports fixed to said arm in spaced relationship therealong and projecting upwardly therefrom for releasable engagement with the respective front and rear support rods, each of said shelf supports projecting upwardly in cantilevered relationship from said arm and at its upper end terminating in a rearwardly-opening U-shaped hook part which defines therein a rearwardly directed slot in which the respective support rod is disposed.

2. A shelf arrangement according to claim 1, wherein said wall clamp means includes upper and lower wall clamps associated with each said bracket and fixedly secured to the wall in vertically spaced relationship, each of said wall clamps having a center part provided with openings therethrough, and fastener means extending through said openingsinto said wall for fixedly attaching the wall clamp to the wall, each said wall clamp also having vertically-extending edge parts disposed in horizontally spaced relationship on opposite sides of said center part for supportive engagement with the hook means on the bracket, and said hook means as provided on said bracket includes a pair of sidewardly-spaced upper hooks and a pair of sidewardly-spaced lower hooks which are disposed vertically downwardly from said pair of upper hooks, said hooks all projecting vertically downwardly, and each said pair being adapted for engagement with a respective said wall clamp, said pair of sidewardly-spaced hooks when engaged with the respective wall clamp being disposed in sidewardly straddling relationship to the center part of the respective wall clamp.

3. A shelf arrangement according to claim 2, wherein the bracket is defined by a pair of frame elements each formed into a generally rearwardly-opening U-shaped configuration from a single elongate metal rod, each frame element having upper and lower legs joined together by a front leg, said upper and lower legs adjacent their rearward ends terminating in downwardly projecting rodlike parts which define said hook means, said upper and lower legs adjacent their rearward ends being bent sidewardly as they project rearwardly, said frame elements being disposed closely adjacent one another and rigidly joined together whereby the sidewardly bent rear portions of the legs flare outwardly at a small angle relative to one another as they project rearwardly so that pairs of upper and lower hooks are sidewardly spaced apart by a substantial distance which is of a magnitude similar to the width of the respective wall clamp.

4. A shelf arrangement according to claim 3, wherein each of said front and rear shelf supports is formed from an elongate wire rod and includes a vertically-elongated straight rod portion which is sandwiched between said frame elements and is rigidly joined thereto at the points where the straight rod portion contacts the upper and lower legs of the frame elements, said straight rod portion projecting upwardly in cantilevered relationship above the upper legs and having said hook part integrally formed at the upper end thereof.

5. A shelf arrangement according to claim 4, wherein said shelf is of a rigid wire-rod construction and includes front and rear edge rods which are respectively associated with the front and rear edges of the shelf and extend longitudinally therealong, said upper mat including a plurality of parallel metal wires disposed in sidewardly spaced relationship within a substantially horizontal plane and extending transversely across the width of the shelf and being fixed adjacent their ends to said front and rear edge rods, said parallel wires being disposed above and supported directly on said front and rear support rods, said front and rear support rods being spaced between said front and rear edge rods so as to be disposed substantially symmetrically relative to the longitudinally extending central axis of the shelf.

6. A shelf arrangement according to claim 1, wherein the horizontally-elongated arm of the bracket includes elongated upper and lower legs which are rigidly joined together and project outwardly away from said wall, each of said legs adjacent the rearward end thereof defining a pair of sidewardly-spaced leg portions which at their rearward ends terminate in a pair of sidewardly-spaced rodlike hooks which project vertically downwardly and define said hook means, said wall clamp means having a central platelike part which directly contacts the wall and has fasteners extending therethrough for fixed attachment to the wall, said wall clamp means having a sidewardly-spaced pair of hook-receiving parts disposed on opposite sides of the said central part for vertically slidably receiving therein the sidewardly spaced hooks formed on the bracket.

7. A shelf arrangement according to claim 6, wherein the front and rear shelf supports each include an elongate vertical leg which extends intersectingly between and is rigidly joined to the upper and lower legs of the respective bracket and which projects upwardly in cantilevered relationship above the upper leg, said vertical leg at its upper end being integrally joined to said U-shaped hook part.

8. A shelf arrangement mounted in cantilevered relationship on a vertical wall, comprising in combination:

a rigid longitudinally-elongated shelf having longitudinally-extending front and rear edges defined respectively by front and rear edge rods which extend in generally parallel relationship to one another, a plurality of mat wires disposed in generally parallel and sidewardly spaced relationship within a generally horizontal plane and extending transversely across the width of the shelf, said mat wires having opposite ends thereof fixedly secured to said front and rear edge rods, and front and rear support rods disposed in spaced and generally parallel relationship so as to extend longitudinally of said shelf, said front and rear support rods being disposed directly under and in fixed engagement with said mat wires, said front and rear support rods being positioned generally between said front and rear edge rods;

a pair of generally parallel support brackets disposed in longitudinally-spaced relationship beneath said shelf and releasably fixed to said wall so as to project outwardly in cantilevered relationship therefrom, each of said brackets being of a rigid wire construction and releasably attached to the shelf;

each said bracket including a substantially U-shaped frame which is disposed within a vertical plane and opens rearwardly toward the wall, said frame including upper and lower legs joined together by a front leg, said upper leg at its rearward end terminating in a sidewardly-spaced pair of upper hooks which project downwardly, said rear leg terminating at its rearward end in a sidewardly-spaced pair of lower hooks which project downwardly, the pair of lower hooks being generally aligned with and spaced downwardly from said pair of upper hooks;

upper and lower wall clamps adapted to be fixedly secured to said wall in vertically spaced relationship, each of said wall clamps having a center clamping part having a fastener extending therethrough for fixed securement to the wall, each of said wall clamps also having a pair of sidewardly-spaced hook-receiving parts which are disposed on opposite sides of the center part for engagement with a respective pair of said hooks;

said bracket including front and rear shelf supports which are fixed to said frame and project upwardly therefrom for releasable engagement with the respective front and rear support rods, each of said shelf supports projecting upwardly in cantilevered relationship from said frame and terminating in a rearwardly-opening U-shaped hook part, said hook part defining therein a rearwardly-opening slot having a width which approximately corresponds to the height of said support rod so as to snugly accommodate a respective said support rod therein.

9. A shelf arrangement according to claim 8, wherein at least one of said front and rear shelf supports engages its respective support rod for urging the shelf rearwardly for maintaining the shelf rear edge in engagement with the wall.

* * * * *